United States Patent [19]

Berrios et al.

[11] 4,453,055

[45] Jun. 5, 1984

[54] LOUVERED ARC CHUTE

[75] Inventors: Rafael Berrios, Villa Carolina; Harold E. Belttary, Rio Piedras, both of

[73] Assignees: Challenger Caribbean Corporation, Canovanas, P.R.; Commander Electrical Equipment, Inc., Scarborough, Canada

[21] Appl. No.: 437,713

[22] Filed: Oct. 29, 1982

[51] Int. Cl.[3] ..... H01H 33/10

[52] U.S. Cl. ..... 200/147 R; 200/144 R

[58] Field of Search ..... 200/144 R, 147 R

[56] References Cited

U.S. PATENT DOCUMENTS

| | | | |
|---|---|---|---|
| 2,460,118 | 1/1949 | Bennett | 200/147 R |
| 2,524,287 | 10/1950 | Ellis | 200/147 R |
| 2,632,827 | 3/1953 | Rypinski | 200/147 R |
| 2,898,427 | 8/1959 | Nadeau | 200/147 R |
| 4,405,846 | 9/1983 | Belttary | 200/147 R |

*Primary Examiner*—Robert S. Macon

*Attorney, Agent, or Firm*—Frederick A. Zoda; John J. Kane

[57] ABSTRACT

A "U" shaped arc chute, formed in a single piece stamping, with louvered openings at the center section. The louvers cool and safely direct gases, generated during short circuit operation of a circuit breaker, away from the metal front of circuit breaker panel board, thereby reducing the likelihood of an electric arc striking between the circuit breaker line terminal contact and the circuit breaker enclosure. The louvered arc chute is durable, and provides a barrier to prevent access to the interior of the circuit breaker.

12 Claims, 6 Drawing Figures

LOUVERED ARC CHUTE

BACKGROUND OF THE INVENTION

1. Field of the Invention

This invention relates to louvered arc chutes, and, in particular, to arc chutes utilized in electric circuit breakers for directing the short circuit blast in a safe direction. Accordingly, it is a general object of this invention to provide new and improved arc chutes of such character.

2. Description of the Prior Art

One prior art type of arc chamber barrier, utilized in electric circuit breakers, has been a fine mesh screen. Disadvantageously, the fine mesh screen did not influence the direction of arc supporting vapors, gases and particles being expelled from the arc chamber of the circuit breaker. Further, during a severe short circuit, there was a tendency for the fine wires of the screen to melt and blow out into a metal circuit breaker enclosure, thereby increasing the likelihood of arcing between the line terminal and the enclosure.

Other prior art arc chutes utilize a plurality of arc plate grids, in addition to a screen barrier. Disadvantageously, multiple parts increase assembly labor and material costs.

3. Statement Pursuant to 37 CFR 1.56

The following United States patents may be material to the examination of the application. Though these patents were called to the attention of the applicant as a result of a routine novelty search, no conclusion is asserted that such search was one hundred percent effective, or that no better art exists.

| U.S. Pat. No. | Patentee | Issue Date |
|---|---|---|
| 2,460,118 | Bennett | Jan. 25, 1949 |
| 2,524,287 | Ellis | Oct. 3, 1950 |
| 2,632,827 | Rypinski | Mar. 24, 1953 |
| 2,898,427 | Nadeau | Aug. 4, 1959 |

Bennett, U.S. Pat. No. 2,460,118, discloses an open type arc chute including two spaced plates of electrically insulating material, shaped to provide a converging arc discharging channel at the top. The two plates are held within a U-shaped magnetic member having upwardly offset flanged portions that embrace the outer faces thereof. At low altitudes (in aircraft where the apparatus is located), an arc is rapidly distended and unable to escape from the converging discharging channel, until it has sufficiently cooled to be rapidly extinguished in the vicinity of the throat of the channel. At high altitudes, where the arc is sluggish, strong magnetic action tends to keep the arc moving, and the cross section of the arc is reduced by the magnetic action which drives the arc into the converging channel where it is cooled sufficiently to be interrupted. No mention is made by Bennett of the burning attributes of the arc chute, including the insulating plates thereof. It is noted that neither the construction nor the function of Bennett is similar to, nor suggestive of, the louvered arc chute of this instant invention.

Ellis, U.S. Pat. No. 2,524,287, discloses an arc extinguishing structure in the form of a conductive or magnetic cup, such that an arc, when drawn, is directed generally thereinto as a result of the magnetic field produced by the current or arc path and the cup. The shape of the cup and the contact relation are such that the magnetic field is always inward towards the bottom of the cup, thus confining the arc to the inside of the cup until extinction occurs. Thus, the arc is prevented from burning or forming conductive particles on the surfaces of insulative materials, which might lead to tracking and dielectric breakdown. However, the cup-shape configuration of Ellis is structurally and effectively different from the louvered arc chute of the instant invention.

Rypinski, U.S. Pat. No. 2,632,827, discloses a device for minimizing the effects of arcs formed on breaking an electric circuit, such, for example, as a switch or circuit breaker. The device is an arc-quenching housing consisting of magnetic metal having four side walls and an end wall, confining the contacts both in the contacting and separated positions. A vent opening through one wall of the housing is spaced from the separation point of the contacts. The housing confines the flame and the molten metal resulting from an arc formed on the separation of the contacts.

Nadeau, U.S. Pat. No. 2,898,427, discloses a one-piece arc extinguishing means comprising a generally U-shaped member of magnetic metallic material having side portions disposed on either side of the path of a movable contact, and extending completely between the contact closed and the contact open positions of the movable contact, the bight portion thereof extending parallel to the path of movement of the movable contact and being provided with a plurality of parallel slots extending generally perpendicular to the path of movement of the movable contact, the slots also being extended into the opposite side portions. In contradistinction, the louvered arc chute of the instant invention provides slots that extend into, and are continuous through, a louvered bight portion from both sides. The unique louvered improvement on the slots provides directional venting with additional cooling surfaces, and a protecting barrier to prevent undesirable elements from being introduced into the circuit breaker mechanism. Integral mounting features of the louvered arc chute hold and position the chute within the molded case housing so that the "U" shaped channel is spaced away from the housing walls, thereby exposing the outside surfaces of the sides of the "U" shaped channel, as well as the housing walls, to hot particles and gases created by a short circuit arc drawn between the contacts. Further, the integral louvered arc chute is mountable in a prior art type molded housing that was designed to receive a "high performance arc stack" consisting of a plurality of arc plates (grids) and retainer liner, a versatility that permits construction of circuit breakers with a common housing that is able to perform under relatively high magnitude fault conditions as well as conventional normal fault conditions.

SUMMARY OF THE INVENTION

Another object of this invention is to provide a new and improved louvered arc chute which can direct expelled gases away from the front of a circuit breaker.

Still another object of this invention is to provide a new and improved louvered arc chute which provides a physical barrier to the internal portions of a circuit breaker.

Yet another object of this invention is to provide a new and improved louvered arc chute that cools and safely deflects hot gases generated during short circuit operation of a circuit breaker.

Still yet another object of this invention is to provide a new and improved louvered arc chute which does not require modification of a molded circuit breaker housing that had been designed for arc plate grids.

In accordance with one aspect of the invention, a combination in a device for making and breaking an electric circuit includes relatively movable contacts movable together to complete a circuit and away from each other to break a circuit. The combination further includes an arc chute which is formed in a U-shape in a single piece stamping. The arc chute has louvered openings in the bight section. The louvered openings are arranged to direct the hot gases and molten metal resulting from an arc formed on the separation of the contacts away from a front face of the device.

In accordance with another aspect of the invention, a combination in a device for making and breaking an electric circuit includes relatively movable contacts, movable together to complete a circuit and away from each other to break a circuit. The combination further includes a urea formaldehyde housing which has formed recesses for retaining an arc chute. The arc chute is formed in a U-shape in a single piece stamping with louvered openings in the bight section. The louvered openings are arranged to direct the flame and molten metal resulting from an arc formed on the separation of the contacts away from a front face of the device. The housing has a vent opening spaced from the separation point of the contacts. The arc chute is oriented to direct the flame and the molten metal toward the vent opening. In accordance with certain features of the invention, the arc chute is formed with pierced and formed louvers for providing efficient cooling surfaces for the ambient (i.e., hot gases and molten metal) associated with electric arcs, while simultaneously offering substantial cross section and resistance to melting and disintegration. The louvered openings in the arc chute can be so formed to inhibit entry of undesired elements into the device via the vent opening. The arc chute can be formed with integral mounting features therein so that the chute is mounted within the housing and is spaced away from the recesses, thereby exposing outside surfaces of the sides of the U-shaped arc chute as well as the recessed walls of the urea formaldehyde housing to hot particles and gases created by a short circuited arc drawn between the contacts.

In accordance with still another aspect of the invention, an electric circuit breaker having a front face includes an insulating casing having an arc chamber and arc chamber walls therein. A relatively stationary contact is mounted in the arc chamber. A relatively movable contact is supported for movement in the arc chamber into and out of engagement with the stationary contact along predetermined paths. A venting passage extends from the arc chamber to the exterior of the casing. Arc cooling and extinguishing means in the arc chamber are provided which include a one-piece, generally U-shaped metallic member having its bight portion extending generally parallel to the path of movement of the movable contact and side portions disposed on opposite sides of the path of the moving contact and extending a selected distance from the path of movement, the selected distance being a function of the features of the device. A plurality of elongated, generally parallel slots extend substantially into both the side portions to provide a plurality of generally U-shaped parallel portions that are spaced away from each other throughout their intermediate portions, but are joined together at the ends of the side portions. The bight portion, where the slots extend, is formed with a cooperating, engaging, like plurality of integrally formed louvers for directing the flame and molten metal resulting from an arc formed on the separation of the contacts along the venting passage away from the front face of the breaker. In accordance with certain features of the invention, the one-piece, generally U-shaped member, at the top and bottom of the bight portion, is formed with sidewise extending projections, the projections being adapted to engage with the arc chamber walls to space the U-shaped member away from the walls, thereby exposing outside surfaces of the side portions of the arc chute as well as the housing walls of the device to the hot ionized gases and molten metal resulting from the arc. The one-piece, generally U-shaped member can be formed with an outwardly extending tab at the ends of each of its side portions for engaging the arc chamber walls and spacing the remainder of the U-shaped member away therefrom.

In accordance with yet another aspect of the invention, a one-piece, generally U-shaped metallic member has a pair of opposing side portions which join with a bight portion. A plurality of elongated, generally parallel slots each extend from the bight portion substantially into each of the side portions, thereby providing a plurality of generally U-shaped, parallel portions spaced away from each other throughout their intermediate portions but joined together at the ends of the side portions. The bight portion where the slots extend, is formed with a cooperating, engaging, like plurality of commonly oriented integrally formed louvers. In accordance with certain features of the invention, the louvers are so formed that introduction of undesirable elements to within the member, but from without the bight portion, is hindered. The top and bottom of the bight portion can be formed with sidewise extending projections, the projections extending outwardly away from the side portions. The free ends of the side portions can be each formed with an outwardly extending tab.

BRIEF DESCRIPTION OF THE DRAWINGS

Other objects, advantages and features of this invention, together with its construction and mode of operation, will be become more apparent, when read in conjunction with the accompanying drawings, in which.

DESCRIPTION OF PREFERRED EMBODIMENT(S)

Figure 2:
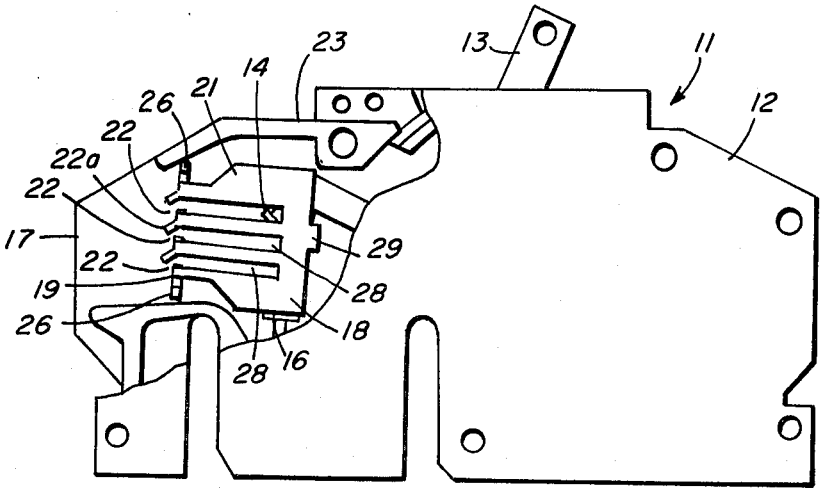
FIG. 2 is a side view of the circuit breaker shown in FIG. 1, taken along the lines 2—2 thereof, the housing being partly broken away to depict the louvered arc chute of this invention.
Figure 3:
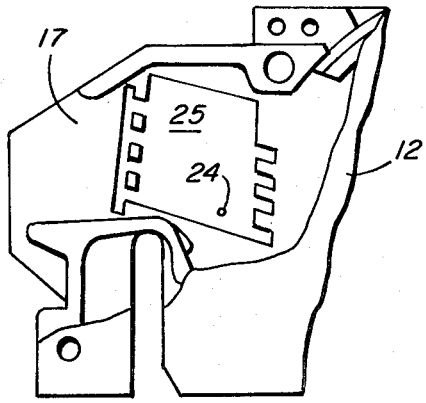
FIG. 3 is a partial side view of the circuit breaker housing of FIG. 2, without the arc chute being depicted therein, the circuit breaker housing depicting an existing recess for prior art type arc plate grids.
Figure 1:
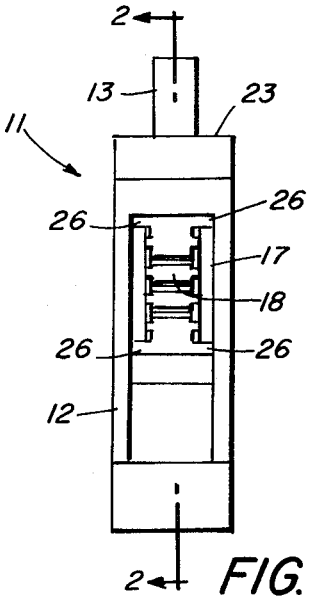
FIG. 1 is an end view of an electric circuit breaker incorporating one embodiment of this invention.

Referring to FIG. 1, there is shown an end view of an electric circuit breaker 11 including a housing 12, a handle 13 being shown in the "off" position. With the circuit breaker 11 in the "tripped" or "off" condition, a relatively movable contact 14 and a relatively stationary contact 16 within the breaker 11 are disengaged or separated from each other.

In accordance with techniques well known in the art, the circuit breaker 11 can be adjusted so that the contacts 14, 16 are closed, the contacts 14, 16 meeting at a point 24 of contact. Upon tripping or "opening" the circuit breaker 11, the movable contact 14 becomes displaced away from the relatively stationary contact 16. When the contacts 14, 16 are opened, due to relatively high current passing therethrough, an arc is produced at the separating point 24 of contact, "open circuiting" the high current path. Depending upon the duration and extent of the current that is being interrupted, flame and molten metal resulting from the arc formed by the separation of the contacts 14, 16 can be produced.

As depicted in the end view of FIG. 1, looking in toward a vent opening or venting passage 17, there is depicted an arc chute 18 in accordance with this invention.

The arc chute 18 is a one-piece, stamped, generally "U" shaped member having a bight portion 19 and opposing side portions 21, 21 which join therewith. Louvered openings 22, 22 in the bight portion 19 are arranged to direct hot ionized gases, flame and molten metal, produced by arcs formed on the separation of the contacts 14, 16, away from a front face 23 of the electric circuit breaker 11.

In general, when a single, "U" shaped, uninsulated, ferrous metal piece is placed in close proximity to the contacts of the circuit breaker or similar device, it will, upon the contacts opening in response to severe fault, cool the ambient in the arc chamber and diminish the amount of gas generation and gas ionization. It becomes part of a series circuit with the contacts and arcs, thereby affecting the resistance of the arc. It absorbs flux lines produced by the arc, and other current carrying members that are in close proximity, thereby producing a magnetic field.

An electric circuit can be made and broken through the use of the relatively movable contacts 14, 16 which are movable together to complete a circuit and away from each other to break the circuit. The housing 12, preferably of urea formaldehyde, is formed with recesses 25 at opposite sides thereof to retain the arc chute 18 therewithin. The vent opening 17, in the housing 12, is spaced from the separation point 24 of the contacts 14, 16. The arc chute 18 is so oriented to direct hot gas, flame, and molten metal toward the vent opening 17. The pierced and formed louvers *22a, 22a* of the arc chute 18 provide efficient cooling surfaces for electric arcs, while simultaneously offering cross-section and resistance to melting and disintegration. The louvered openings 22, 22 inhibit entry of undesired elements into the chute 18 via the vent opening 17.

Figure 4:
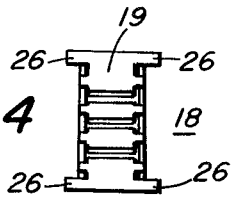
FIG. 4 is an orthogonal view of a generally "U" shaped arc chute in accordance with this invention, looking in towards the bight section thereof.
Figure 6:
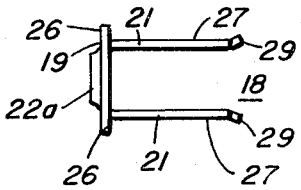
FIG. 6 is a top view thereof.
Figure 5:
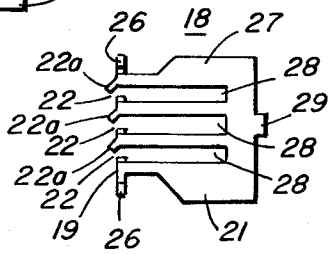
FIG. 5 is a side view of the arc chute depicted in FIG. 4.

The arc chute 18 is provided with integral mounting features, such as sideways extending projections 26, 26 at the top and bottom thereof, as viewed in FIG. 4. The projections 26, 26 extend outwardly away from the side portions 21, 21. The integral mounting features 26, 26 are so formed, that when the chute 18 is mounted within the housing 12, the chute 18 is spaced away from the recesses 25, thereby exposing the outside surfaces 27, 27 of the sides 21, 21 of the "U" shaped arc chute 18, as well as recessed walls 25 of the urea formaldehyde housing 12, to hot particles and ionized gases that are created by an arc drawn between the contacts 14, 16 during interruption of a high fault current.

The sidewise extending projections 26, 26 are adapted to engage with the arc chamber walls to space the arc chute 18 therefrom. Thus, the outside surfaces 27, 27 of the side portions 21, 21 are exposed, as well as the walls, to the hot gases, flame and the molten metal that result from the arc. The one-piece, generally "U" shaped member 18 is formed with an outwardly extending tab 29 at each of the ends of the side portions 21, 21 for engaging the arc chamber walls and for spacing the "U" shaped member 18 away therefrom.

As an overall entity, the electric circuit breaker 11, in accordance with this invention, includes an insulating casing 12 having an arc chamber and arc chamber walls defined by the recesses 25. The relatively stationary contact 16 is mounted in the arc chamber. The relatively movable contact 14 is supported for movement in the arc chamber into and out of engagement with the stationary contact 16 along predetermined paths. The venting passage 17 extends from the arc chamber to the exterior of the casing 12. Arc cooling and extinguishing are effectuated by the arc chute 18. The bight portion 19 of the metallic chute 18 extends generally parallel to the path of movement of the movable contact 14. The side portions 21, 21 are disposed on opposite sides of the path of movement. The bight portion 19 and side portions 21, 21 extend a selected distance from the path of movement, the selected distance being a function of the device configuration. Each of a plurality of elongated, generally parallel slots 28, 28 extends substantially into both of the side portions 21, 21 to provide a plurality of generally "U" shaped parallel portions 21, 21 spaced away from each other throughout their immediate portions, but joined together at the ends of the side portions 21, 21. The bight portion 19, where the slots 28, 28 extend, are formed with a cooperating, engaging, like plurality of integrally formed louvers *22a, 22a* for directing the hot ionized gases and molten metal away from an arc formed on the separation of the contacts 14, 16 along the venting passage 17 away from the front face 23 of the breaker 11.

Each of the slots 28, 28 extends from the bight portion 19 substantially into each of the side portions 21, 21 providing a plurality of generally "U" shaped parallel portions spaced away from each other throughout their intermediate portions, but joined together at the ends of the side portions 21, 21. The bight portion 19, where the slots 28, 28 extend, are formed with the cooperating, engaging, like plurality of commonly oriented integrally formed louvers *22a, 22a*. Each of the free ends of the side portions 21, 21 is formed with an outwardly extending tab 29, bent outwardly at a 45° angle.

The slots 28, 28 of the louvered arc chute 18 extend into and are continuous through the side portions thereof. The louvers *22a, 22a* on the bight portion 19 cool and safely direct hot gases generated during short circuit operation of the circuit breaker 11.

The unique louvered improvement of the bight portion provides directional venting, additional cross-sectional structure to resist disintegration, and additional cooling surfaces, as well as a protective barrier to inhibit undesirable elements from being introduced into the circuit breaker 11.

Through this invention, arc chamber venting is improved. The louvered openings 22, 22 are formed in such a manner that a short circuit blast is directed away from the metal front of a circuit breaker panel board. Arc chamber barriers of the prior art , utilizing a fine mesh screen, do not adequately influence the direction of arc supporting vapors, gases and particles that are expelled from the arc chamber during interruption of high fault current. Thus, the louvered arc chute 18, in accordance with this invention, greatly reduces the chances of an electric arc striking between a circuit breaker line terminal contact and the circuit breaker enclosure by safely directing the conductive blast materials away from nearby portions of the circuit breaker enclosure.

The unique integral mounting features of the louvered arc chute 18 position and hold the chute 18 within a molded case housing so that the "U" shaped channel is spaced away from the housing walls, thereby exposing the outside surfaces of the sides of the "U" shaped channel, as well as the housing walls, to hot particles and gases that are created by a short circuit arc drawn in between the channels.

An advantage of this invention is that, by its nature, the louvered arc chute is much more durable than a screen type barrier of the prior art. During severe short circuit operation, there is a tendency for the fine wires of a screen to melt and blow out into a circuit breaker enclosure, thereby adding to the chances of arcing between line terminals and the metal cabinet. The pierced and formed louvers of the improved arc chute of this invention provide efficient cooling surfaces, while at the same time offering substantial cross-section resistance to melting and disintegration. Further, the single piece U-shaped arc chute of this invention efficiently replaces three arc plate grids of the prior art, as well as a screen barrier used in a former design. Replacing these elements simplifies the molded house design, and reduces assembly labor and material costs. Furthermore, the single piece louvered arc chute of this invention is mountable in a molded housing that was designed to receive a high performance arc stack that consisted of a plurality of arc plates to retain their liners. This permits the versatile construction of circuit breakers that are able to perform under relatively high magnitude fault conditions as well as conventional or normal fault conditions, all utilizing the same molded case housing configuration.

Various modifications of this invention may be performed without departing from the spirit and scope of this invention. For example, the term "point of contact" is to be broadly construed to include "area of contact".

What is claimed is:

1. In a device for making and breaking an electric circuit, the combination comprising relatively movable contacts, movable together to complete a circuit and away from each other to break a circuit and an arc chute formed in a "U" shape in a single piece stamping with louvered openings in the bight section, the louvered openings being arranged to direct the hot gases and molten metal resulting from an arc formed on the separation of the contacts away from a front face of said device.

2. In a device for making and breaking an electric circuit, the combination comprising relatively movable contacts, movable together to complete a circuit and away from each other to break the circuit, an arc chute, and a urea formaldehyde housing having formed recesses therein for retaining said arc chute, said arc chute being formed in a "U" shape in a single piece stamping with louvered openings in the bight section, the louvered openings being arranged to direct the flame and molten metal resulting from an arc formed on the separation of contacts away from a front face of said device, said housing having a vent opening spaced from the separation point of the contacts, and said arc chute being oriented to direct said flame and said molten metal toward said vent opening.

3. The combination as recited in claim 2, wherein said arc chute is formed with pierced and formed louvers for providing efficient cooling surfaces for the ambient hot gases and molten metal associated with electric arcs while simultaneously offering substantial cross section and resistance to melting and disintegration.

4. The combination as recited in claim 2, wherein said louvered openings in said arc chute are so formed to inhibit entry of undesired elements into said device via said vent opening.

5. The combination as recited in claim 2 wherein said arc chute is formed with integral mounting features therein so that said chute is mounted within said housing and spaced away from said recesses thereby exposing outside surfaces of the sides of the "U" shaped arc chute as well as the recessed walls of the urea formaldehyde housing to hot particles and gases created by a short circuited arc drawn between said contacts.

6. An electric circuit breaker, having a front face, comprising an insulating casing having an arc chamber and arc chamber walls therein, a relatively stationary contact mounted in said arc chamber, a relatively movable contact supported for movement in said arc chamber into and out of engagement with said stationary contact along predetermined paths, a venting passage extending from said arc chamber to the exterior of said casing, and arc cooling and extinguishing means in said arc chamber comprising a one-piece generally U-shaped metallic member having its bight portion extending generally parallel to the path of movement of said movable contact and its side portions disposed on opposite sides of said path of said movable contact and extending a distance from said path of movement, a plurality of elongated generally parallel slots each extending substantially into both of said side portions to provide a plurality of generally U-shaped parallel portions spaced away from each other throughout their intermediate portions but joined together at the ends of said side portions, said bight portion where said slots extend being formed with a cooperating engaging like plurality of integrally formed louvers for directing the hot gases and molten metal resulting from an arc formed on the separation of said contacts along said venting passage away from the front face of said breaker.

7. The circuit breaker as recited in claim 6 wherein said one-piece generally U-shaped member at the top and bottom of said bight portion is formed with sidewise extending projections, said projections being adapted to engage with said arc chamber walls to space said U-shaped member away from said walls, thereby exposing outside surfaces of said side portions as well as said walls to said hot gases and molten metal resulting from said arc.

8. The circuit breaker as recited in claim 7 wherein said one-piece generally U-shaped member is formed with an outwardly extending tab at the ends of each of said side portions for engaging said arc chamber walls and thus spacing said U-shaped member away therefrom.

9. A one-piece, generally U-shaped metallic member having a pair of opposing side portions which join with a bight portion, a plurality of elongated generally parallel slots each extending from said bight portion substantially into each of said side portions, providing a plurality of generally U-shaped parallel portions spaced away from each other throughout their intermediate portions but joined together at the ends of said side portions, said bight portions where said slots extend being formed with a cooperating engaging like plurality of commonly oriented integrally formed louvers.

10. The metallic member as recited in claim 9 wherein said louvers are so formed that introduction of undesirable elements to within said member but from without said bight portion is hindered.

11. The metallic member as recited in claim 9 wherein the top and bottom of said bight portion is formed with sidewise extending projections, said projections extending outwardly away from said side portions.

12. The metallic member as recited in claim 11 wherein each free end of said side portions is formed with an outwardly extending tab.

* * * * *